US005639267A

United States Patent [19]

Loudermilk

[11] Patent Number: 5,639,267

[45] Date of Patent: Jun. 17, 1997

[54] MODULAR JACK ASSEMBLY

[75] Inventor: Gregory Loudermilk, Sacramento, Calif.

[73] Assignee: Maxconn Incorporated, San Jose, Calif.

[21] Appl. No.: 592,129

[22] Filed: Jan. 26, 1996

[51] Int. Cl.[6] ..... H01R 13/502

[52] U.S. Cl. ..... 439/701; 439/676; 439/607

[58] Field of Search ..... 439/701, 638, 439/639, 95, 101, 108, 607, 609, 610, 708, 712–715, 676

[56] References Cited

U.S. PATENT DOCUMENTS

| | | | |
|---|---|---|---|
| 4,406,509 | 9/1983 | Jagen | 439/701 |
| 5,419,720 | 5/1995 | Chen | 439/676 |
| 5,496,195 | 3/1996 | Reed | 439/607 |
| 5,531,612 | 7/1996 | Goodall et al. | 439/701 |

*Primary Examiner*—Hien Vu
*Attorney, Agent, or Firm*—Terry McHugh

[57] ABSTRACT

A modular jack assembly includes a housing having a front portion which includes a plurality of openings into a plurality of plug receiving chambers. The housing further has a rear bay which includes openings into the plug receiving chambers. A backplate sub-assembly includes a plurality of contact pin arrays mounted thereto and a grounding shield. Each of the pin arrays is formed of a unitary insulative member in the shape of an L and includes a plurality of embedded contact pins. The backplate sub-assembly further includes an L-shaped elongate backplate member having perforations formed through one of the legs of the L. The perforations receive pins protruding from mounting ends of the pin arrays. Additional perforations are provided to receive ground pins formed in the grounding shield. The backplate sub-assembly is received in the rear bay so that plug contacting portions of the pin arrays extend into the plug receiving chambers. In a preferred embodiment, the jack assembly is arranged to have two rows of jacks and the grounding shield is positioned between the two rows.

18 Claims, 6 Drawing Sheets

MODULAR JACK ASSEMBLY

TECHNICAL FIELD

The present invention relates generally to receptacles for modular plugs and more specifically to a stacked shielded modular jack assembly.

BACKGROUND ART

Modular plugs are widely used to provide electrical connections between devices. For example, RJ-11 type modular plugs are typically found on telephone sets to connect the telephones to a modular jack which ultimately is connected to a telephone switch at the central office. Modular plugs and jacks are also used to connect together computer equipment. U.S. Pat. No. 5,419,720 shows the construction for a typical modular jack. Thus, a computer board may include a modular jack assembly providing a dozen or so jacks into which external devices can be plugged. For example, a communications module may have one or more such modular jack assemblies.

Computer connections, however, are susceptible to noise due to the high frequency signals which are transmitted along the cables between the computer and the external devices. Susceptibility to noise is a special concern in high density applications, such as in communication modules, where dozens of modular jacks must be provided for the connection of communication lines between the computer and a telephone switch. For example, commercial network providers to the INTERNET typically require hundreds of communications lines. Because of the noise that can be generated at the interface between the modular plug and the modular jack, the cross-talk between adjacent jacks can become significant in such applications. It is for this reason that modular jacks assemblies are constructed with shielding provided between the jacks within the assembly and encasing the entire housing of the assembly.

Referring to FIG. 1, a shielded modular jack assembly 20 is shown mounted on printed circuit board 60. The assembly 20 provides two rows of chambers 40 for receiving modular plugs (not shown). As will be shown, the exterior shielding 50 includes grounding pins which contact ground traces on the printed circuit board 60 to provide a path to ground when the assembly 20 is mounted to the board as shown.

FIG. 2 shows an exploded view of a prior art version of a shielded modular jack assembly 100 manufactured by AMP, Inc. The exterior shielding, composed of front and rear portions 102A and 102B, encases a housing 110 containing two rows of pin sub-assemblies 112, 114. Lower pin sub-assemblies 112 are inserted into a lower row of the housing 110, and upper pin sub-assemblies 114 are inserted into an upper row of the housing. Disposed between the two rows within the housing 110 is an interior shielding plate 104.

FIGS. 3–6 show more detailed views of the lower and upper contact pin sub-assemblies 112, 114 of the prior art. The lower contact pin sub-assembly 112 shown in FIGS. 3 and 4 is composed of a mounting plastic portion 120, a contacting plastic portion 121 and a set of contact pins 30 formed through each portion. Likewise, the sub-assembly 114 shown in FIGS. 5 and 6 is composed of mounting and contacting plastic portions 130, 131 and a set of contact pins 30. FIGS. 3 and 5 show the sub-assemblies in a pre-assembled condition. During manufacture, the sub-assemblies are bent into an L shape, as shown in FIGS. 4 and 6, by rotating the mounting portions 120, 130 about the centerline A—A in the direction indicated by the dotted lines in FIGS. 3 and 5. The pin sub-assemblies are assembled by inserting the contacting portions 121, 131 of the L-shaped sub-assemblies 112, 114 into the housing 110 as indicated in FIG. 2.

The housing 110 includes guides to facilitate the insertion of the upper and lower pin sub-assemblies. Referring again to FIGS. 3–6, the sub-assemblies 112, 114 include flanges 128, 138, locking wedges 127, 137 and outward notches 122, 132 which engage corresponding guides formed in the housing, as can be seen in the rear and side views of the housing depicted in FIG. 9. The rear of the housing includes flange guides 182 and wedge guides 181 into which the flanges 128, 138 and locking wedges 127, 137 are fitted, to guide the pin sub-assemblies into the housing. The side view shows that the wedge guides 181 have hook portions 183 which engage the locking wedges 127, 137 of the sub-assemblies to hold the sub-assemblies in place. The outward notches 122, 132 of the sub-assemblies fit into guide rails 140 formed in the housing. The guide rails 140 engage the notches 122, 132 to guide and retain the mounting portions 120, 130 of the sub-assemblies 112, 114 in position within the housing. In addition, each of the upper pin sub-assemblies 114 has a bump 133 formed on the notch 132 which acts as a snap fastener to hold the mounting portion 130 of the sub-assembly 114 in place.

The bending of the contact pin sub-assemblies 112, 114 during the manufacture of the modular jack assembly can be a source of defects in the final product because of the stress placed on the contact pins 30 upon bending. Moreover, where the manufacturing is performed manually, inconsistencies in handling by different assemblers are likely to result in variations in the quality of the final modular jack assemblies.

Referring again to FIG. 2, it can be seen that a portion of the contact pins 30 protrude from the mounting portions 120, 130 of each of the contact pin sub-assemblies 112, 114. When the pin sub-assemblies are inserted into the housing 110, all of the protruding pins are aligned along the bottom of the housing. The pins extend into a printed circuit board when the modular jack assembly is mounted onto the printed circuit board.

The pins protruding from the mounting portions 120, 130 of the pin sub-assemblies 112, 114 are aligned and held in position by virtue of the sub-assemblies being inserted into the housing 110 and by the rear portion of the external shielding 102B pressing against the sub-assemblies. Nevertheless, misalignment of the protruding pins among the sub-assemblies is possible, since each sub-assembly is assembled into the housing 110 separately from and is mechanically independent of the other sub-assemblies. A misalignment of the pins in the modular jack assembly can make it difficult to align the pins to the corresponding openings on the printed circuit board during assembly of the board.

It is an object of the present invention to provide a modular jack assembly that is less complex to manufacture, thus improving the reliability and quality of the final product. It is a further object of the present invention to provide a modular jack which is less complex with respect to mounting to printed circuit boards and which exhibits improved shielding from noise.

SUMMARY OF THE INVENTION

The modular jack of the present invention includes a housing having a front face with openings into plug receiving cavities. A rear loading bay of the housing includes openings to the plug receiving cavities from the rear. A backplate sub-assembly is received within the rear loading bay of the housing. The backplate sub-assembly includes a backplate and a plurality of contact pin arrays mounted to the backplate. The backplate is an elongate member having two walls arranged in an L shape, one wall being perforated. A plurality of channeled mounting sites is formed on the inside of the L-shaped backplate. The channels run in a direction that is perpendicular to the perforated wall. In addition, the channels are aligned with the perforations formed on the wall. Each contact pin array is composed of a unitary insulative member formed in the shape of an L to match the shape of the backplate. A set of contact pins is embedded within the unitary member and protrude from the end of each leg of the L-shape. Grooves formed on the outside portion of a first leg of the L-shaped unitary member frictionally engage the channels of the mounting sites. In addition, the channels serve to guide the pins protruding from the first leg of the unitary member through the perforations in the backplate. The backplate sub-assembly further includes a shield plate disposed between two rows of contact pin arrays. The shield plate includes grounding pins which extend through additional perforations formed in the perforated wall of the backplate.

In a preferred embodiment, the plug receiving cavities of the modular jack are arranged along at least two rows. Likewise, the contact pin arrays of the backplate sub-assembly are arranged in at least two rows. An external grounding shield encloses the entire modular jack assembly.

BEST MODE FOR CARRYING OUT THE INVENTION

Figure 1:
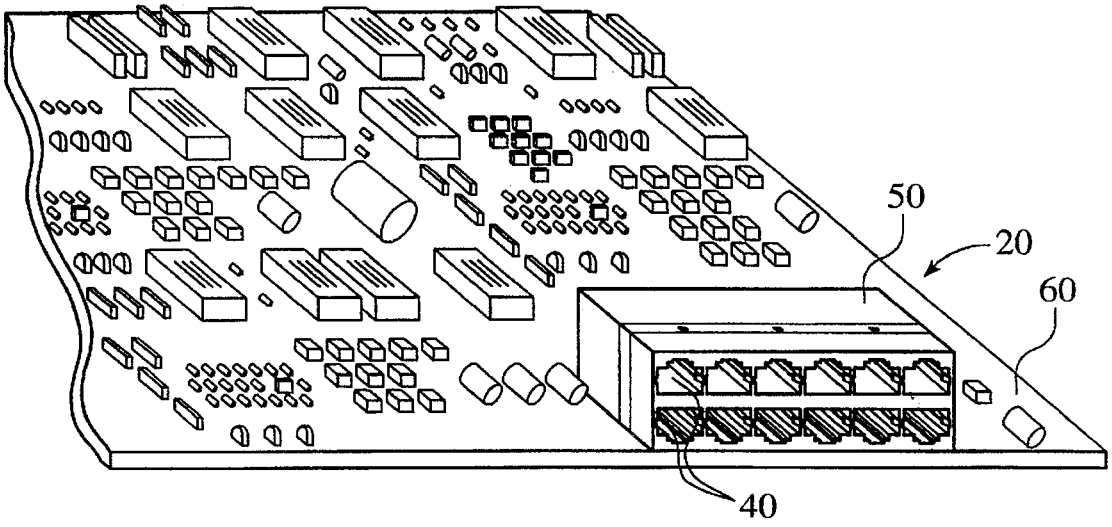
FIG. 1 illustrates a shielded modular jack assembly mounted to a printed circuit board.
Figure 2:
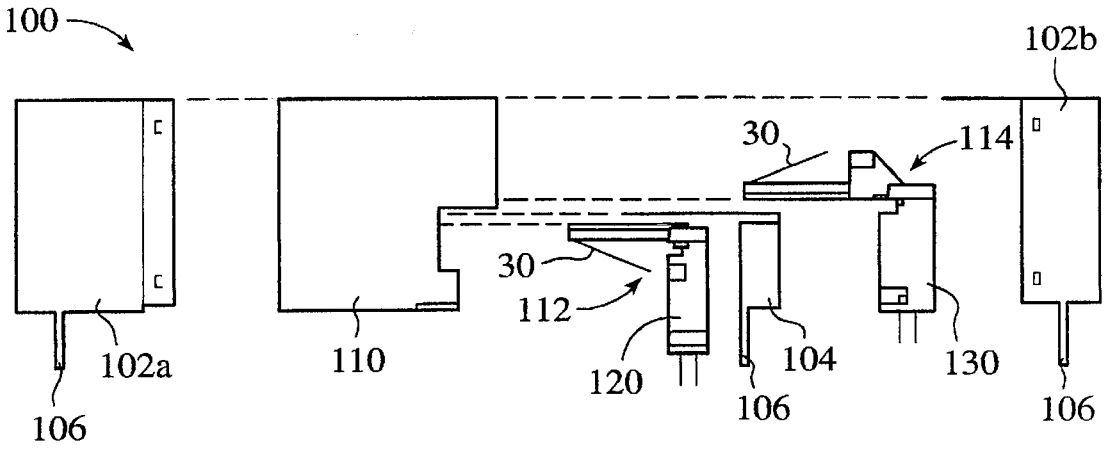
FIG. 2 (PRIOR ART)
FIG. 2 shows an exploded view of a prior art modular jack assembly.
Figure 7:
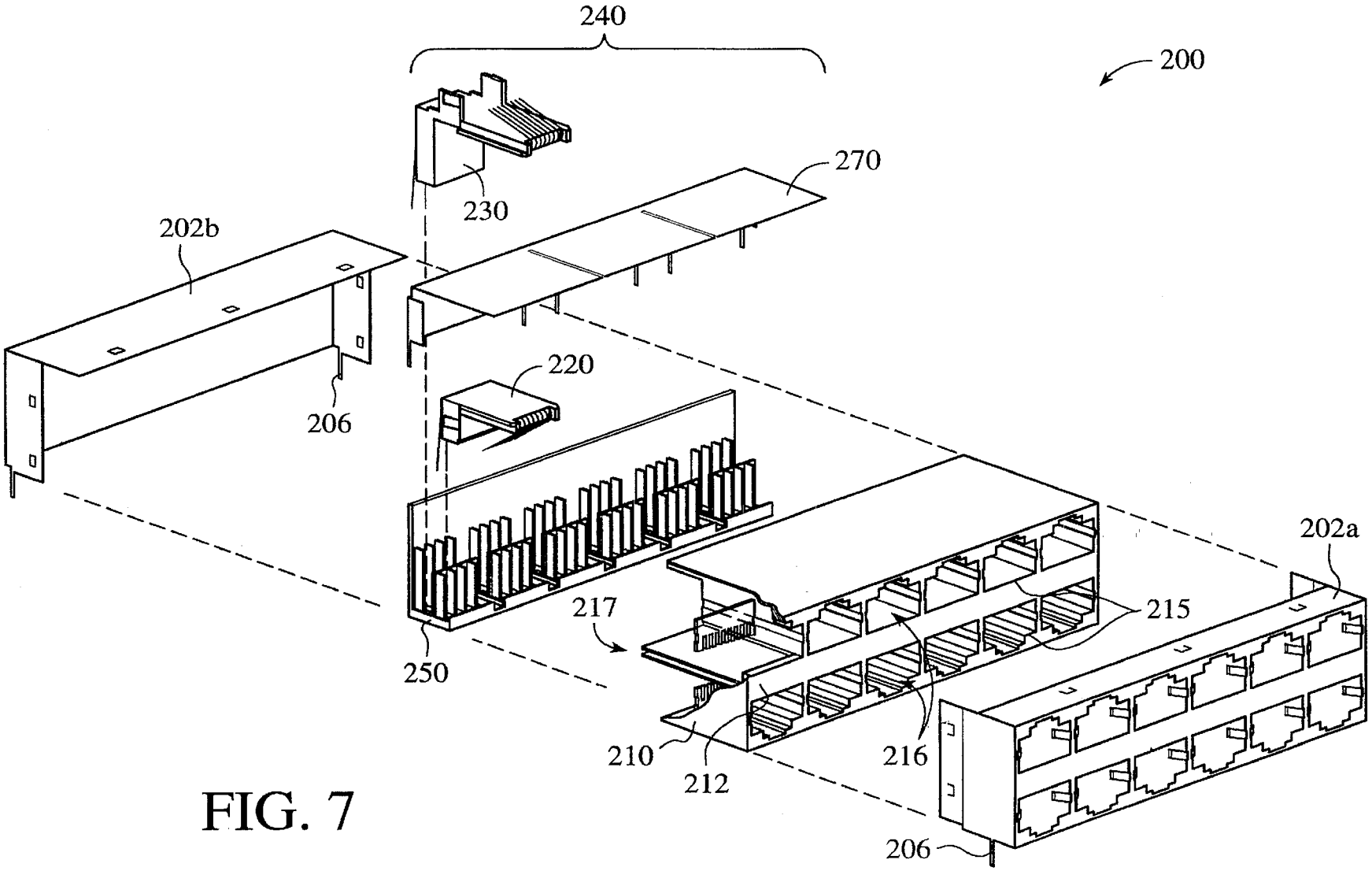
FIG. 7 shows an exploded view of the modular jack assembly in accordance with the present invention.

FIG. 7 illustrates an exploded view of a modular jack assembly 200 of the present invention, showing the individual components of the assembly. Front and rear external shield portions 202A, 202B enclose the combination of a housing 210 and a backplate sub-assembly 240. Each of the two external shielding portions 202A, 202B includes grounding pins 206 which, when the assembly 200 is mounted to a printed circuit board (see for example FIG. 1), are connected to ground traces on the board. The housing 210 includes a front face 212 having a plurality of apertures 215 opening into a plurality of cavities or chambers 216 for receiving modular plugs (not shown). FIG. 7 shows the preferred embodiment, wherein the modular plug receptacles 216 are arranged along two rows. Although not shown, a modular plug assembly having more than two rows of receptacles falls within the scope of the present invention.

Figure 8:
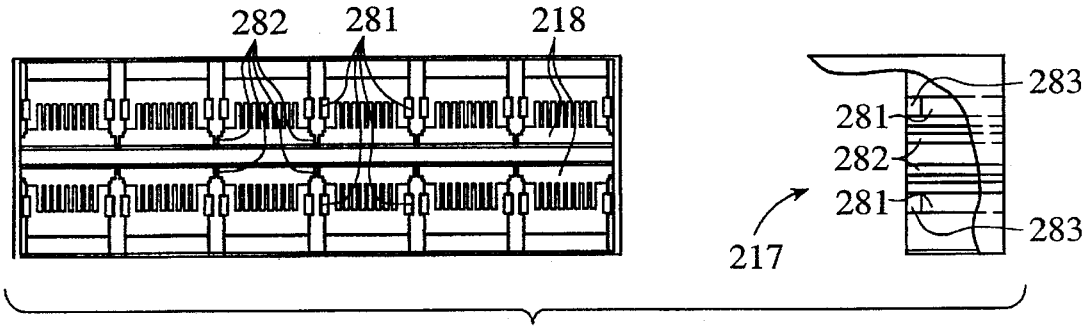
FIG. 8 is a view of the rear of the housing of the present invention shown in FIG. 7.
Figure 9:
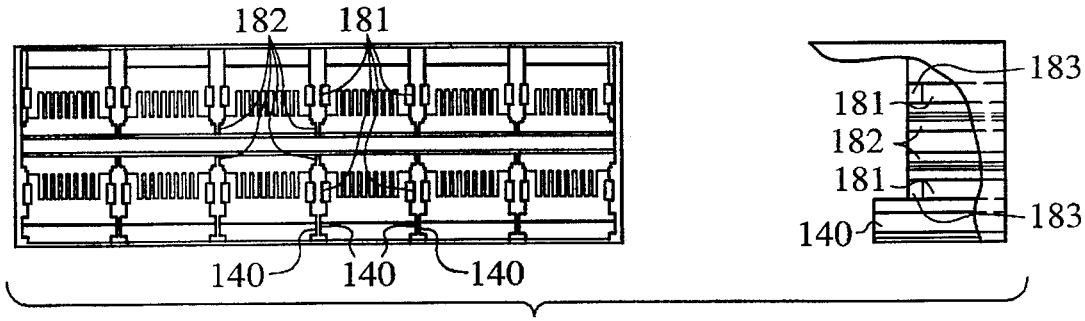
FIG. 9 (PRIOR ART)
FIG. 9 is a view of the rear of the prior art housing shown in FIG. 2.

Turning to FIG. 8, a rear view and a side view of the housing 210 show a rear loading bay 217. The loading bay 217 includes apertures 218 which open into each of the plug receiving cavities 216. Guides 281, 282 corresponding to each aperture 218 are included to facilitate the insertion of the backplate sub-assembly 240 during manufacture in a manner that will be described below.

Returning to FIG. 7, the backplate sub-assembly 240 is composed of a backplate member 250 to which a plurality of contact pin arrays 220, 230 is attached. In the preferred embodiment, as noted above, the pin arrays are arranged along two rows upper contact pin arrays 230 form the upper row, while lower pin arrays 220 are arranged along the bottom row. Disposed between the two rows of pin arrays is a conductive shield plate 270. The individual components of the backplate sub-assembly 240 will now be described in greater detail.

Figure 10:
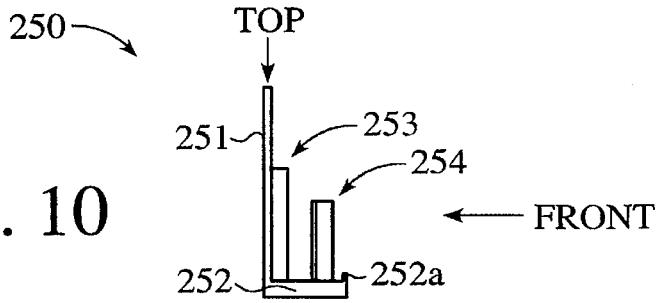
FIGS. 10–14 show orthogonal and perspective views of the backplate member shown in FIG. 7.
Figure 11:
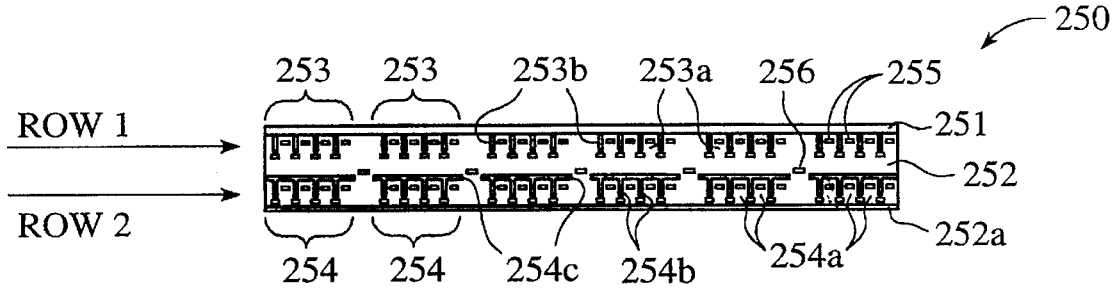
Figure 12:
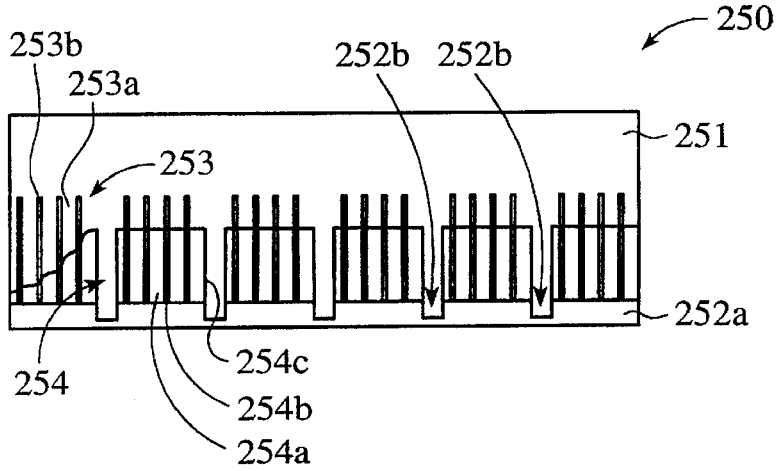
Figure 13:
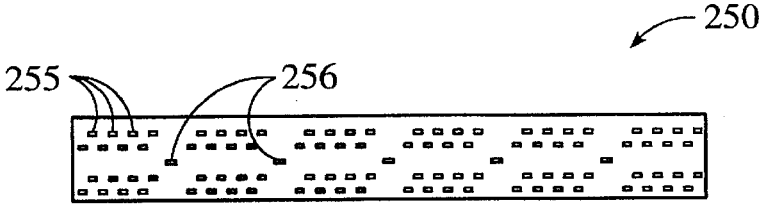
Figure 14:
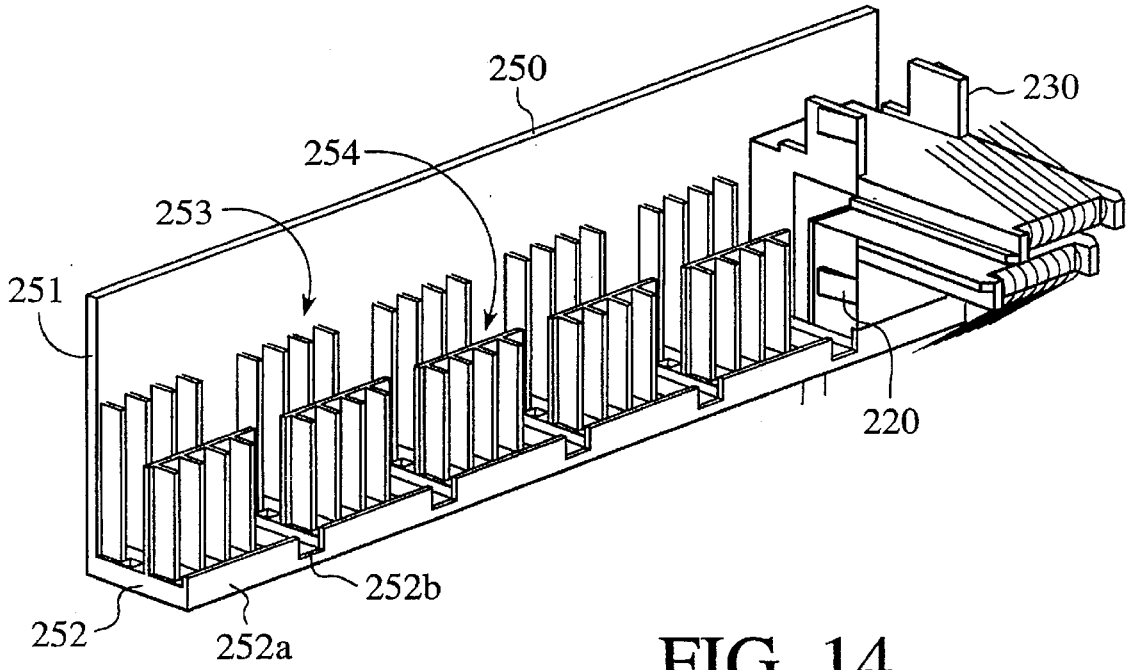

The backplate member 250 of the sub-assembly 240 is illustrated in FIGS. 10–14. The figures show various views of the backplate member 250. FIG. 10 shows a side view of the backplate member, while FIGS. 11, 12 and 13 show the top, front and bottom views respectively. FIG. 14 shows a perspective view of a partially assembled backplate sub-assembly 240.

From the side view of FIG. 10, the backplate member 250 can be seen to consist of two walls, a vertical wall 251 and a horizontal wall 252, arranged in the shape of an L. Each of the two walls 251, 252 has an elongate shape, as seen in FIG. 14. An upwardly extending lip portion 252A is formed along the length of the front portion of the horizontal wall 252. As shown in FIG. 12, the lip portion 252A includes notches 252B formed along its length.

Returning to FIG. 10, grooved attachment sites 253, 254 are formed on the "inside" region of the L shape. FIGS. 11 and 14 more clearly illustrate the attachment sites 253, 254. The top view of FIG. 11 shows two rows of attachment sites ROW1, ROW2, each row having six attachment sites 253, 254. The ROW1 attachment sites 253 are integrally formed with the vertical wall 251. The grooves (or channels) 253A of the ROW1 attachment sites 253 run in a generally vertical direction, being delineated by strips 253B which extend a slight distance perpendicularly from the vertical wall 251 of the backplate member 250 and a substantially greater distance perpendicularly from the horizontal wall 252 of the backplate member, FIG. 12. The ROW2 attachment sites 254 are spaced apart from the vertical wall 251 of the backplate member and supported by a support wall 254C. Grooves (or channels) 254A of the ROW2 sites 254 run in a generally vertical direction, being delineated by strips 254B which extend a slight distance perpendicularly from the support wall 254C and a substantially greater distance perpendicularly from the horizontal wall 252.

The horizontal wall 252 of the backplate member 250 includes a series of perforations 255, 256 formed through the horizontal wall, as can be seen in FIGS. 11 and 13. FIG. 11 shows that a first plurality of the perforations (or holes) is aligned with the grooved attachment sites 253, 254. These holes 255 are referred to as "contact" holes. Some of the contact holes 255 are formed at the base of the grooves (or channels) 253A, 254A of the attachment sites. Other contact holes 255 are aligned at the edges of the strips 253B, 254B of the attachment sites. A second plurality of the perforations is formed between the two rows of attachment sites ROW1, ROW2. For reasons that will become clear, the second plurality of openings in the horizontal wall 252 is referred to as "ground" holes 256.

Figure 15:
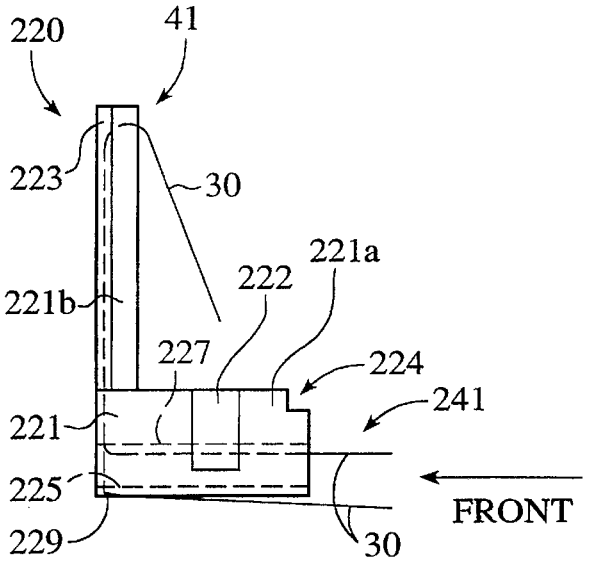
FIGS. 15 and 16 are detailed views of the lower contact pin array shown in FIG. 7.
Figure 16:
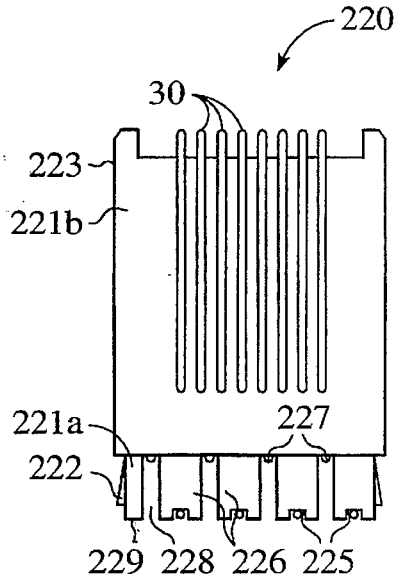

Turning now to FIGS. 15 and 16, more detailed illustrations of the lower contact pin arrays 220 of the backplate sub-assembly 240 are shown. The pin array 220 is composed of a unitary member 221 of insulative material formed in the shape of an L having two legs 221A, 221B. A locking wedge 222 is formed on the leg 221A and the leg 221B includes a flange 223. The leg 221A also includes a notched recess 224 formed at the end of the leg. A plurality of contact pins 30 is embedded in the unitary member 221. As shown in FIG. 15, the contact pins 30 are formed through the interior of the L-shaped member 221 and bend around the elbow of the L, so that the pins run along pin-guides 225, 227 formed in the leg 221A of the L. The contact pins extend beyond the end of each of the legs 221A, 221B of the L-shaped member. The contact pins 30 protruding from the end of one leg 221A extend straight out. For reasons that will become clear, this end of the L-shaped unitary member 221 is referred to as a mounting end 241. The contact pins extending from the other leg 221B of the L bend back over the leg 221B, toward the "inside" region of the L. This end of the L shape is referred to as a plug contacting end 41 of the unitary member 221.

The pin-guides 225, 227 of the pin array 220 are more clearly illustrated by the front view of FIG. 16. A first set of pin guides 227 is defined by deeply recessed grooves (or channels) 228 which extend inwardly from the exterior surface 229 of the leg 221A, defining spaced apart slots 226. The bases of the deep grooves 228 delineate the pin-guides 227 within which some of the contact pins 30 fit. A second set of pin-guides 225 is recessed into the ends of the slots 226, but only to a slight depth as compared to the depth of the deep grooves 228 as seen in the figure. The depth of the recesses of the second pin-guides 225 is substantially equal to the width of the contact pins 30 which fit within these guides so that the contact pins are flush with the exterior surface 229 of the leg 221A.

Figure 17:
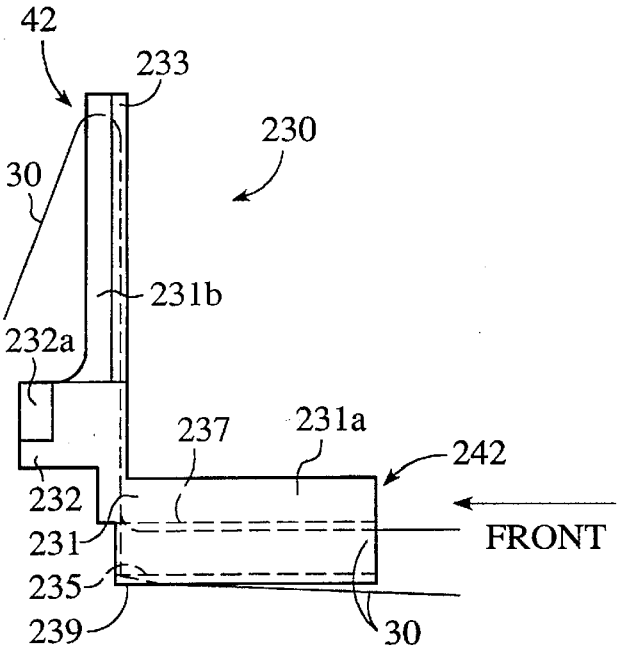
FIGS. 17 and 18 are detailed views of the upper contact pin array shown in FIG. 7.
Figure 18:
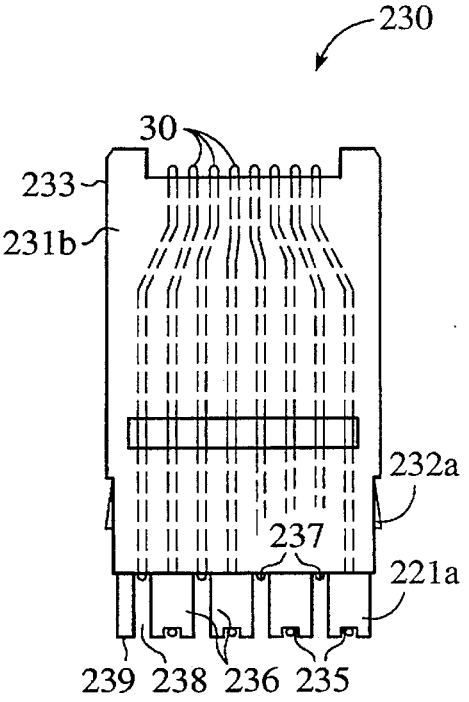

FIGS. 17 and 18 illustrate the upper contact pin arrays 230 of the backplate sub-assembly 240 shown in FIG. 7. Like the lower pin array 220, the upper pin array 230 is composed of a solid insulative body 231 that is formed in the shape of an L having legs 231A, 231B. A handle 232 is formed on the leg 231A and the leg 231B includes a flange 233. The handle 232 includes a locking wedge 232A. A plurality of contact pins 30 is embedded within the L-shaped body 231. The pins 30 follow the L-shape of the body and bend at the elbow of the L so that the pins fit into pin-guides 235, 237 formed in the leg 231A of the L. The contact pins 30 extend beyond the end of each of the legs 231A, 231B of the L-shaped body 231 of the pin array 230. The pins protruding from the end of the leg 231A extend straight out. For reasons that will become clear, this end of the leg 231A is referred to as the mounting end 242. The pins extending from the end of the other leg 231B are bent back over the leg, away from the "inside" region of the L-shaped body 231 and extend toward the "outside" region of the L. This end of the L is known as the plug contacting end 42.

The pin-guides 235, 237 of the pin array 230 are more clearly illustrated by the front view shown in FIG. 18. A first set of pin guides 237 is defined by deeply recessed grooves (or channels) 238 which extend inwardly from the exterior surface 239 of the leg 231A, forming a series of spaced apart slots 236. The bases of the deep grooves 238 delineate the pin-guides 237 within which some of the contact pins 30 fit. A second set of pin-guides 235 is recessed into the slots 236, but only to a slight depth as compared to the depth of the channels 238. The depth of the recess of the second pin-guides 235 is substantially equal to the width of the contact pins 30 which fit within the guides so that they are flush with the exterior surface 239 of the leg 231A.

Figure 19:
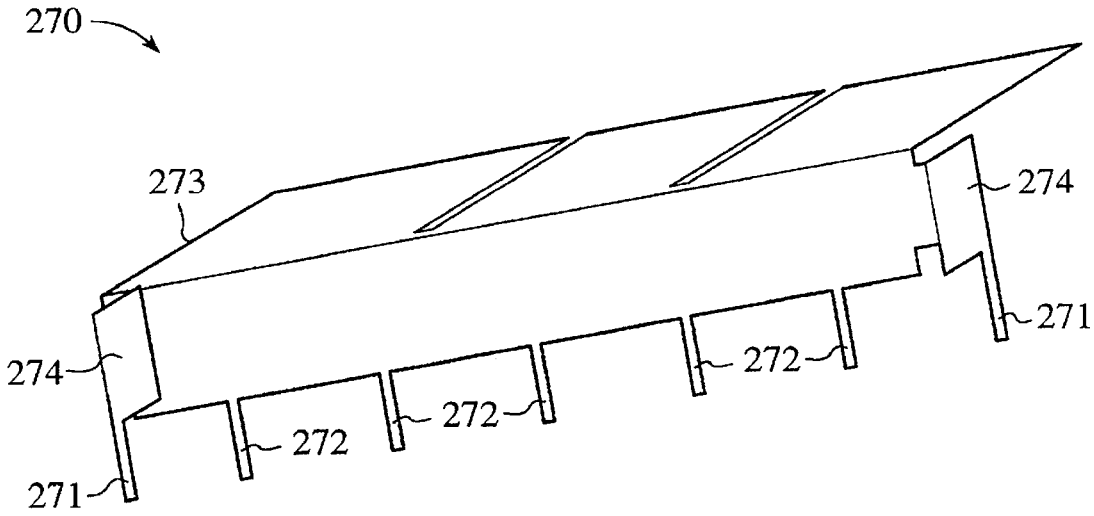
FIG. 19 illustrates the interior shield plate shown in FIG. 7.

Referring to FIG. 19, the conductive shield plate 270 of the backplate sub-assembly 240 is an elongate L-shaped electrically conductive member 273, having end-flaps 274 which straddle the housing 210 (FIG. 7) of the modular jack assembly. End-flap grounding pins 271 extend downwardly from the end-flaps 274 of the plate 270. A series of internal grounding pins 272 is formed along the length of the plate 270 and extend in a downward direction.

Referring to FIGS. 10–18, the discussion will now focus on the assembly of the backplate sub-assembly 240 shown in FIG. 7. Each of the upper and lower contact pin arrays 220, 230 is coupled to the backplate member 250 in the same manner. Consider the lower pin array 220 (FIGS. 15, 16), for example. The mounting end 241 of the pin array 220 is coupled to one of the ROW2 attachment sites 254. The strips 254B of an attachment site fit between the slots 226 and within the deep grooves 228 formed in the mounting end of the pin array. The dimensions of the dimensions are selected so that a friction fit is obtained. The result of the coupling is that the contact pins 30 protruding from the mounting ends 241 of the pin array 220 are aligned with and extend through the contact holes 255 corresponding to the attachment site 254. The lower pin array 220 has an additional coupling not present in the upper pin arrays 230, namely the notched recess 224 of the lower pin array engages the lip portion 252A of the horizontal wall 252 of the backplate member 250.

Figure 3:
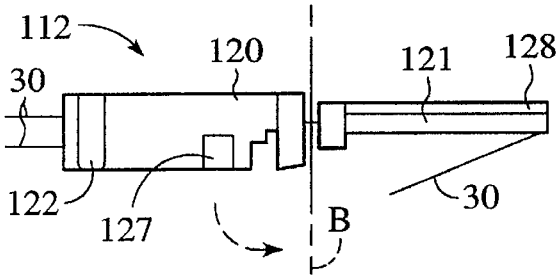
FIG. 3 (PRIOR ART)
FIGS. 3 and 4 provide detailed views of the lower contact pin sub-assemblies shown in FIG. 2.
Figure 4:
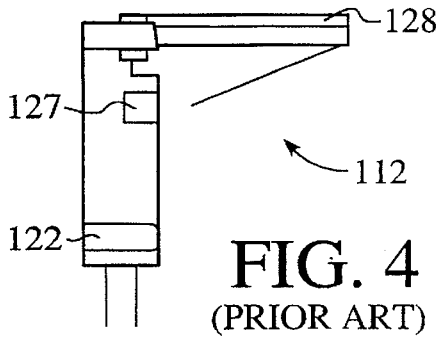
FIG. 4 (PRIOR ART)
Figure 5:
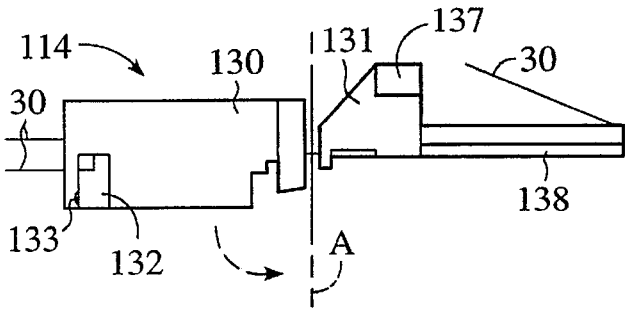
FIG. 5 (PRIOR ART)
FIGS. 5 and 6 provide detailed views of the upper contact pin sub-assemblies shown in FIG. 2.
Figure 6:
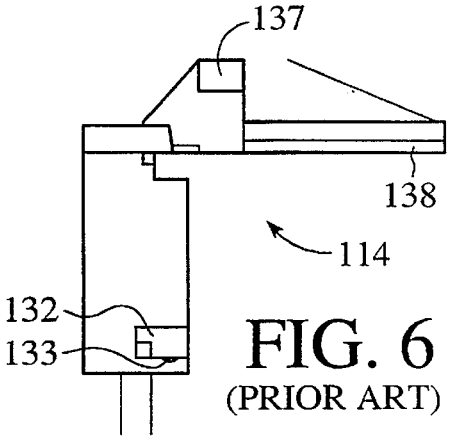
FIG. 6 (PRIOR ART)

The above-described coupling provides a secure fitting between each pin array 220, 230 and attachment site 253, 254. Furthermore, the widths of the channels 228, 238 in the pin arrays are substantially equal to the widths of the contact pins 30, as is the separation between the strips 253B and 254B of the backplate member 250. This ensures self-alignment of the pins 30 with the contact holes 255 formed in the backplate member 250. This is advantageous during manufacture because alignment of the contact pins to the contact holes is simplified. Another advantage over the prior art modular jack assemblies is that each contact pin array 220, 230 of the present invention is formed as a unitary solid member having the required L shape to its form. Thus, while the pin sub-assemblies 112, 114 (FIGS. 3, 5) of the prior art must be bent into the proper shape during assembly, the present invention eliminates this step by using pre-formed contact pin arrays. This increases the reliability of the final product by eliminating the likelihood of damaging the contact pins due to the stress of manual bending.

As can be seen in FIGS. 7 and 19, the backplate sub-assembly 240 includes a shield plate 270, shown disposed between the two rows of attachment sites ROW1, ROW2. The shielding serves to provide a ground path to minimize cross-talk due to noise generated at the interface between the modular jacks and the modular plugs. While the external grounding pins 271 on the shield plate 270 are typical, the shield plate 270 of the present invention provides additional internal grounding pins 272. The grounding pins 272 are aligned with and extend through the ground pin openings 256 formed in the backplate member 250. These additional internal grounding pins 272 provide a more effective ground path than is possible with the prior art jack assembly.

FIG. 14 is a perspective view of a partially assembled backplate sub-assembly 240, showing the relative orientation of the upper and lower pin arrays 230, 220 when they are loaded into the backplate member 250. In a fully assembled sub-assembly, having a full complement of upper and lower pin arrays, the mounting ends 241, 242 of the pin arrays are firmly held in place and the contact pins which extend outwardly from the mounting ends and through the perforations 255 in the backplate member 250 are kept in alignment. The assembled backplate sub-assembly is a compact unit which is easily loaded into the rear loading bay 217 of the housing 210 in the manner shown in FIG. 7. The plug contacting portions 41, 42 of the pin arrays are received through the rear openings 218 of the rear loading bay 217 and are disposed within the modular plug receptacles 216.

Returning to FIG. 8, the rear view of the housing 210 shows wedge guides 281 and flange guides 282 corresponding to each opening 218. These guides help to guide a fully assembled backplate sub-assembly 240 into position within the loading bay 271 of the housing. The locking wedges 222, 232 and flanges 223, 233 of the pin arrays (FIGS. 15 to 18) respectively engage and slide into the wedge guides 281 and flange guides 282 of the housing. When the sub-assembly is fully inserted, the locking wedges 222, 232 of the pin arrays engage hook portions 283 formed within the wedge guides 281 to lock the sub-assembly 240 into the housing 210. Completing the assembly of the modular jack are the front and rear portions of the external shielding 202A, 202B which enclose the housing/backplate sub-assembly combination.

I claim:

1. A modular jack contact pin assembly comprising:

an elongate back plate member having a generally L-shaped cross section; and a plurality of contact pin arrays;

each said contact pin array including a unitary insulative member having a plurality of contact pins embedded therein, said unitary member further having an L shape, a portion of the L shape being inserted into said generally L-shaped cross-section of said elongate back plate member, said L-shaped unitary member having first and second legs;

each of said contact pins having a first and a second portion protruding from an end of said first leg and an end of said second leg respectively;

said elongate back plate member including a first wall having a plurality of holes formed therethrough, said elongate back plate member further including a plurality of grooved attachment sites extending perpendicularly relative to said first wall and aligned with said holes;

each said unitary member having grooves formed upon an exterior surface of said first leg thereof to frictionally engage said grooved attachment sites of said elongate back plate member;

each said unitary member being attached to said elongate back plate member such that said grooves of said first leg engage one of said grooved attachment sites and said first portions of said contact pins are aligned by said grooved attachment sites so as to extend through said holes of said first wall;

wherein said first wall of said elongate back plate member includes additional holes formed through said first wall for receiving ground pin means.

2. The pin assembly of claim 1 wherein said plurality of contact pin arrays is arranged along two rows and the pin assembly further includes an elongate conductive shield disposed between said two rows.

3. The pin assembly of claim 2 wherein said elongate conductive shield includes downwardly depending ground pins formed along the length thereof, said ground pins extending through said additional holes.

4. A modular jack assembly comprising:

a housing having a forward face and a rearward bay, said forward face having a plurality of plug receiving apertures opening into a plurality of corresponding plug receiving cavities, said rearward bay having a hole into each said plug receiving cavity;

a backplate having a plurality of channeled guides; and a plurality of contact pin arrays, each having a solid non-conductive member within which a plurality of contact pins is formed, each said solid non-conductive member including a plug contacting region exposing first portions of said contact pins;

each of said contact pin arrays being coupled to one of said channeled guides, said plug contacting regions of said contact pin arrays extending upwardly from said backplate, whereby the combination of said backplate and said contact pin arrays is a backplate pin sub-assembly;

said backplate pin sub-assembly being received within said rearward bay of said housing so that said plug contacting regions of said contact pin arrays extend through said holes of said rearward bay and into said plug receiving cavities, thereby disposing said exposed first portions of said contact pins within said plug receiving cavities;

whereby insertion of a modular plug into one of said plug receiving cavities will cause exposed first portions of contact pins disposed within said cavity to electrically contact corresponding pins in said modular plug;

wherein said backplate has the shape of an L having a first leg, each said solid non-conductive member further includes a mounting region exposing second portions of said contact pins, said first leg of said backplate has a plurality of holes formed through said first leg, and said second portions of said contact pins extend through said holes.

5. The modular jack assembly of claim 4 wherein said second portions of said contact pins are aligned to said holes by said channeled guides of said backplate.

6. The modular jack assembly of claim 4 wherein said plug receiving cavities are arranged along two rows and said channeled guides of said backplate are arranged along two rows.

7. The modular jack assembly of claim 7 wherein said backplate further includes a second plurality of holes formed through said first leg and said backplate pin sub-assembly further includes a conductive shield being disposed between said two rows of channeled guides and having ground pins extending through said second plurality of holes.

8. The modular jack assembly of claim 7 wherein, for each of said contact pin arrays, said first portions of said contact pins extend beyond said plug contacting region of said unitary member and are bent back over said plug contacting region.

9. A modular jack assembly comprising:

a housing having an exterior mounting surface and a plurality of plug receiving cavities, each cavity having a forward hole for receiving a modular plug and having a rearward hole;

a plurality of contact pin arrays, each including an insulative unitary member formed in the shape of an L and having a plurality of conducting wires spacedly disposed and embedded within said member, said conducting wires extending along a first leg of said L and protruding from the end of said first leg to form spring leads, said conducting wires further extending along a second leg of said L and protruding from the end of said second leg to form mounting leads, said second leg having grooves formed into the exterior surface thereof; and a backplate having a perforated wall, a back wall extending upwardly from said perforated wall and a plurality of mating members for engaging each one of said plurality of contact pin arrays;

each one of said mating members having grooves aligned with respective ones of a plurality of holes in said perforated wall of said backplate and matched with said grooves of said second legs of said contact pin arrays, whereby said mounting leads of a contact pin array extend through said holes when said contact pin array is engaged with one of said mating members;

said contact pin arrays being engaged with said mating members of said backplate such that said spring leads extend away from said back wall of said backplate, the combination of said backplate and said contact pin arrays being a backplate assembly;

said backplate assembly being coupled to said housing so that said spring leads of said contact pin arrays extend through said rearward holes of said housing and into said plug receiving cavities, and so that said mounting leads of said contact pin arrays protrude in a direction perpendicular to said exterior mounting surface of said housing.

10. The modular jack assembly of claim 9 wherein said plug receiving cavities of said housing and said mating members of said backplate are arranged along two rows.

11. The modular jack assembly of claim 10 wherein said perforated wall includes ground pin holes and said backplate assembly further includes a grounding shield disposed between said two rows, said grounding shield having ground pins which extend through said ground pin holes.

12. The modular jack assembly of claim 11 further including an external ground shield enclosing said housing.

13. The modular jack assembly of claim 10 wherein for each of said contact pin arrays said spring leads are bent back over said first leg.

14. The modular jack assembly of claim 13 wherein said spring leads of said contact pin arrays engaged on a first row of mating members are directed away from said spring leads of said contact pin arrays engaged on a second row of mating members.

15. A stacked modular jack assembly comprising:

a housing having a plurality of plug receptacles arranged along at least two horizontal rows, said housing further having a front face, a rearward loading bay and a bottom mounting surface, said front face having a first plurality of openings into said plug receptacles, said rearward loading bay having a second plurality of openings into said plug receptacles; and a backplate assembly including an elongate coupling member, a plurality of pin arrays and a shielding plate, said backplate assembly being fitted to said rearward loading bay;

said coupling member having first and second walls arranged in an L shape and further having a plurality of sets of grooves formed on the inside of said L shape of said coupling member and extending in a direction perpendicular to said first wall and arranged along at least two horizontal rows;

said first wall of said coupling member having first holes formed therethrough, said first holes being aligned with said sets of grooves;

each said pin array including a unitary insulative member having an L shape having a first leg and a second leg, said first leg having grooves formed along the exterior surface thereof, said pin array further including lead wires formed within said insulative member, one end of said lead wires extending along said grooves of said first leg and beyond the end of said first leg to form mounting pins, another end of said lead wires extending beyond the end of said second leg of said L shape of said insulative member and bent back over said second leg to form contact pins;

each said pin array being coupled to said coupling member such that said grooves of each said pin array engages one of said sets of grooves of said coupling member and said mounting pins are aligned with and pass through said first holes in said first wall of said coupling member;

said first wall further including second holes formed therethrough, said shielding plate and said second holes being disposed between said two rows of said sets of grooves, said shielding having grounding pins which extend through said second holes;

whereby said second legs of said pin arrays extend into said plug receiving cavities through said second plurality of openings when said backplate assembly is fitted to said rearward loading bay.

16. The stacked modular jack assembly of claim 15 wherein for each said pin array said first leg is perpendicular to said first wall of said coupling member and said second leg is parallel to said first wall.

17. The stacked modular jack assembly of claim 15 wherein said contact pins of a first row of pin arrays bend in a direction opposite to that of said contact pins of a second row of pin arrays.

18. The stacked modular jack assembly of claim 15 further including a ground shield enclosing said housing.

* * * * *